US006473054B1

(12) United States Patent
Lopez et al.

(10) Patent No.: US 6,473,054 B1
(45) Date of Patent: Oct. 29, 2002

(54) ARRAY ANTENNAS WITH NOTCHED RADIATION PATTERNS

(75) Inventors: Alfred R. Lopez, Commack, NY (US); Henry L. Bachman, Cold Spring Harbor, NY (US)

(73) Assignee: BAE System Aerospace Inc., Greenlawn, NY (US)

( * ) Notice: Subject to any disclaimer, the term of this patent is extended or adjusted under 35 U.S.C. 154(b) by 0 days.

(21) Appl. No.: 09/928,135

(22) Filed: Aug. 10, 2001

(51) Int. Cl.[7] ..... H01Q 9/16

(52) U.S. Cl. ..... 343/820; 343/810; 343/853; 342/375

(58) Field of Search ..... 343/810, 814, 343/820, 822, 850, 853; 333/141; 342/375

(56) References Cited

U.S. PATENT DOCUMENTS 3,618,092 A * 11/1971 Waineo ..... 342/149
4,818,958 A * 4/1989 Lee et al. ..... 333/114
5,021,800 A * 6/1991 Rilling ..... 342/372

* cited by examiner

*Primary Examiner*—Tan Ho
(74) *Attorney, Agent, or Firm*—Edward A. Onders; Kenneth P. Robinson

(57) ABSTRACT

A source of interference signals may be present at a fixed incident angle relative to a stationary antenna. Horizontal array antennas are provided with radiation pattern notches or nulls at selected fixed angles to suppress reception of interference signals. By excitation of elements on the left side of an array in opposite phase relative to elements on the right side and provision of an appropriate line-length differential between left and right radiation element feed lines, a radiation pattern notch is positioned at a selectable angle relative to boresight. Notch width optimization is provided by use of relative excitation levels of radiating elements as disclosed. Other configurations are disclosed.

18 Claims, 6 Drawing Sheets

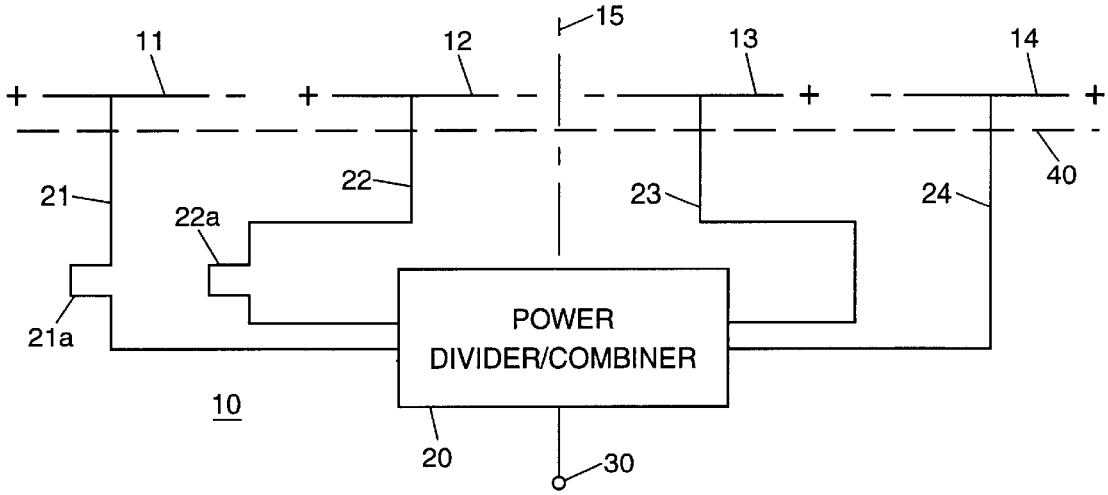
FIG. 1
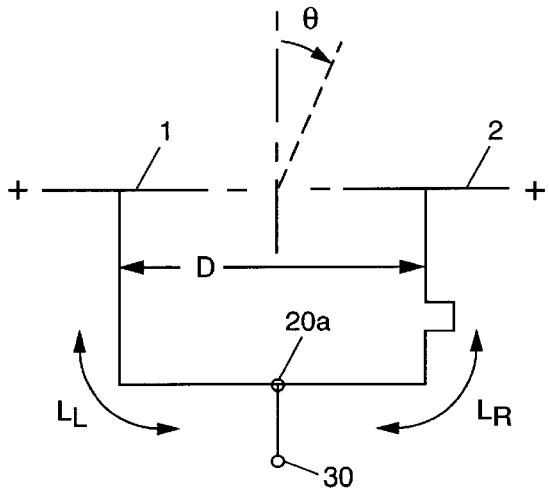
FIG. 2
| Number of Elements | Element Number | | | | | | | |
|---|---|---|---|---|---|---|---|---|
| | 1 | 2 | 3 | 4 | 5 | 6 | 7 | 8 |
| 2 | -1 | 1 | | | | | | |
| 4 | -1/3 | -1 | 1 | 1/3 | | | | |
| 6 | -1/5 | -1/3 | -1 | 1 | 1/3 | 1/5 | | |
| 8 | -1/7 | -1/5 | -1/3 | -1 | 1 | 1/3 | 1/5 | 1/7 |
FIG.3

| Scan Angle (°) | Element Excitation | Array Factor Pattern | Element Spacing (λ) | 6 dB Notch Width (°) |
|---|---|---|---|---|
| 0 | 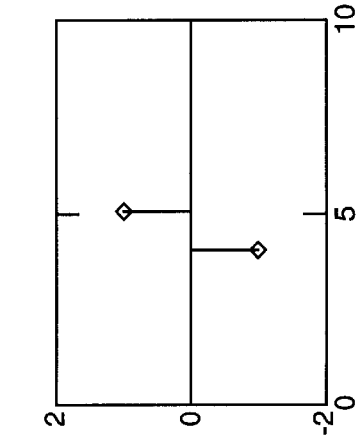 | 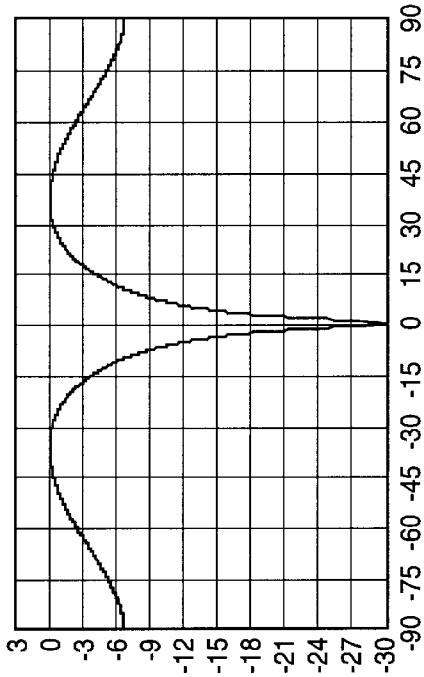 | 0.85 | 22.7 |
| 30 | 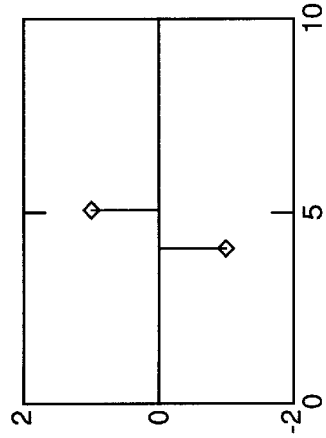 | 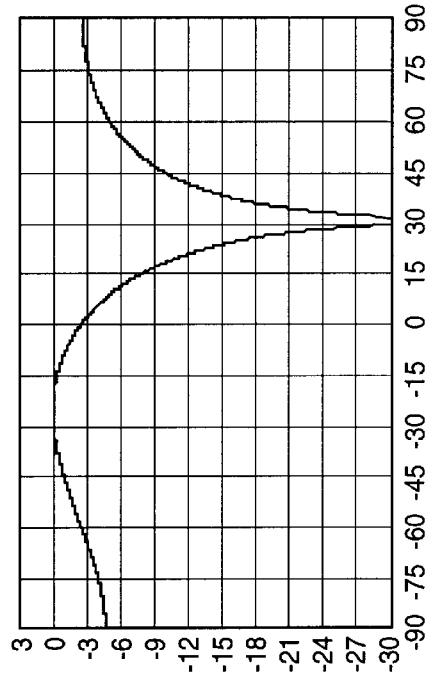 | 0.53 | 43 |
FIG. 4 CONTD.

| Scan Angle (°) | Element Excitation | Array Factor Pattern | Element Spacing (λ) | 6 dB Notch Width (°) |
|---|---|---|---|---|
| 0 |  |  | 1 | 4.46 |
| 30 |  |  | 2/3 | 7.72 |

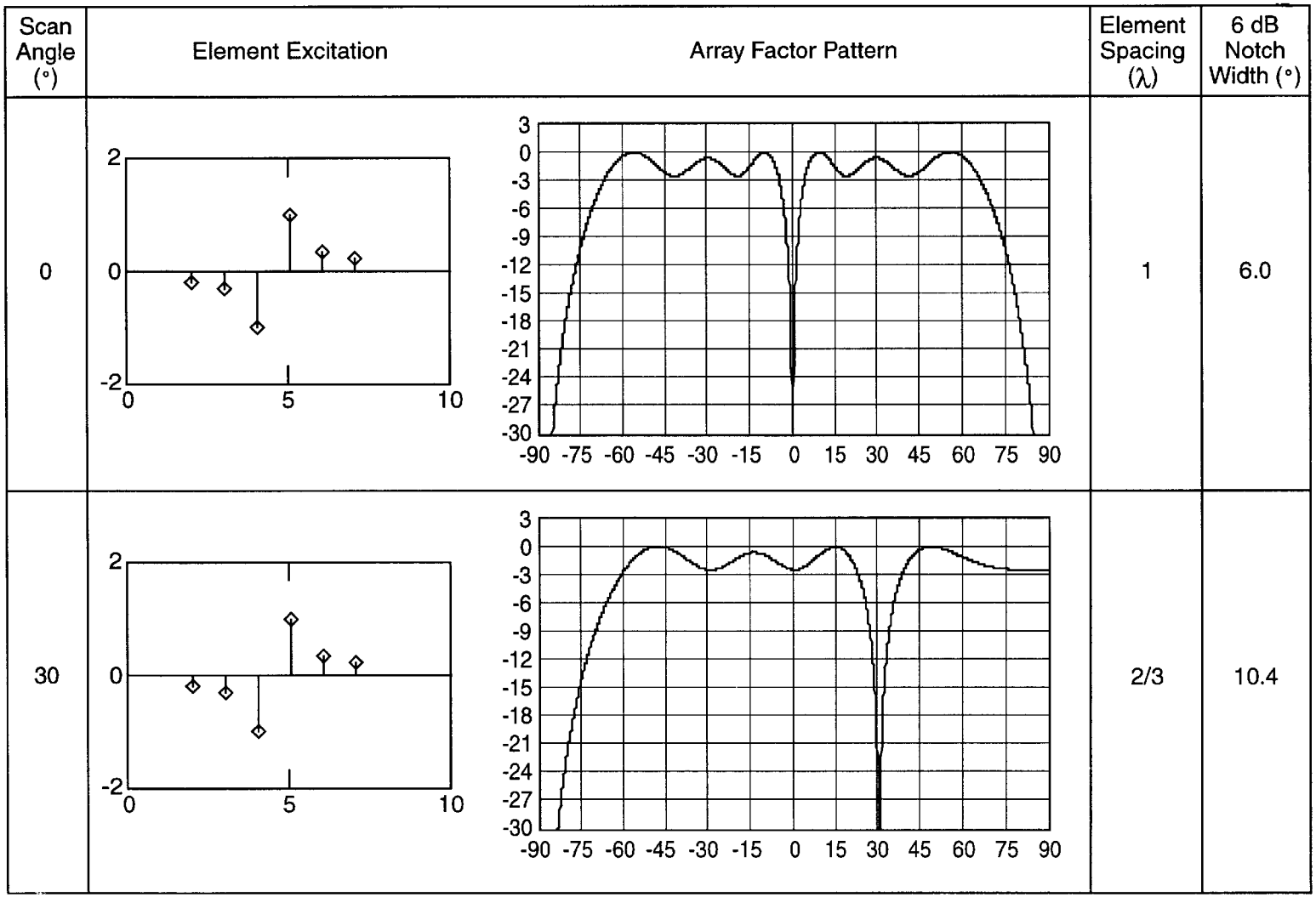
FIG. 5 CONTD.

ARRAY ANTENNAS WITH NOTCHED RADIATION PATTERNS

RELATED APPLICATIONS (Not Applicable)

FEDERALLY SPONSORED RESEARCH (Not Applicable)

BACKGROUND OF THE INVENTION

This invention relates to array antennas and, more particularly, sector antennas which may be subject to interference signals incident at a fixed azimuth angle within the sector.

Array antennas may be employed to cover an azimuth sector. For example, for cellular communications, three antennas may provide omnidirectional coverage with each antenna having a radiation pattern, or beam, 120 degrees wide in azimuth.

Considering a single such antenna, sources of interference signals may be present and may be disruptive of reception of signals within its particular azimuth sector. To limit the effects of such interference, there have been proposed adaptive signal processing techniques capable of suppressing or reducing the effective antenna pattern gain at the azimuth angle of an interference source (i.e., reducing radiation pattern gain applicable to the azimuth angle at which interfering signals are incident at the antenna).

Adaptive signal processing and other prior techniques may typically have two particular attributes. First, such techniques may be capable of automatically steering a reduced gain pattern notch to the azimuth of an interference source and, further, may be capable of tracking the azimuth of such source as it moves. Second, such techniques are typically relatively complex and costly in implementation, and may be subject to operative frequency bandwidth limitations, as well as long-term reliability limitations. These factors may make the use of such techniques impractical in many applications. It should be noted that effects of interference can also be reduced or avoided by use of an antenna providing a narrow, focused radiation pattern (e.g., a fan beam). However, use of antennas with radiation patterns focused to provide coverage of only a narrow angular region may be impractical where the objective is to cover a relatively wide angular region (e.g., a 120 degree wide azimuth sector).

Accordingly, objects of the present invention are to provide new and improved array antennas which may have one or more of the following characteristics and capabilities:

- low complexity, low cost provision of a radiation pattern notch;
- radiation pattern notch fixed in azimuth;
- radiation pattern notch at azimuth angle selected to correspond to incident angle of an interference source within a sector;
- radiation pattern notch with gain null within notch;
- undiminished gain outside of the notch; and
- operation over a wide frequency band, with stable notch properties.

SUMMARY OF THE INVENTION

In accordance with the invention, an array antenna, to provide sector coverage with a radiation pattern notch at a selected angle (Θ) within the sector, includes a horizontal linear array of radiating elements, with at least one left-side element and at least one right-side element, and a power divider/combiner. All left-side elements are arranged for nominally opposite-phase excitation relative to all right-side elements. The antenna also includes left and right coupling lines respectively coupled between the power divider/combiner and the left-side and right-side elements, with a left coupling line having a line-length differential ($L_L$–$L_R$) relative to a right coupling line. The line-length differential is selected to provide a phase differential between excitation of left-side and right-side elements to modify the nominally opposite-phase excitation to produce the radiation pattern notch at the selected angle (Θ), relative to array boresight.

The array antenna may include two or a higher even number of radiating elements. In presently preferred embodiments the power divider/combiner is configured to provide relative excitation amplitudes of: nominally 1 for each of the first pair of radiating elements, which are adjacent to array center; nominally 1/3 for each of a second pair of radiating elements, which if present are outwardly adjacent to the first pair; nominally 1/5 for each of a third pair of radiating elements, which if present are outwardly adjacent to the second pair; and nominally 1/7 for each of a fourth pair of radiating elements, which if present are outwardly adjacent to the third pair.

For a better understanding of the invention, together with other and further objects, reference is made to the accompanying drawings and the scope of the invention will be pointed out in the accompanying claims.

BRIEF DESCRIPTION OF THE DRAWINGS

FIG. 1 is a simplified block diagram of a four element array antenna utilizing the invention.

FIG. 2 illustrates relevant parameters in the context of a two element array antenna.

FIG. 3 is a table of relative excitation levels for antennas with different numbers of radiating elements.

DESCRIPTION OF THE INVENTION

Figure 4:
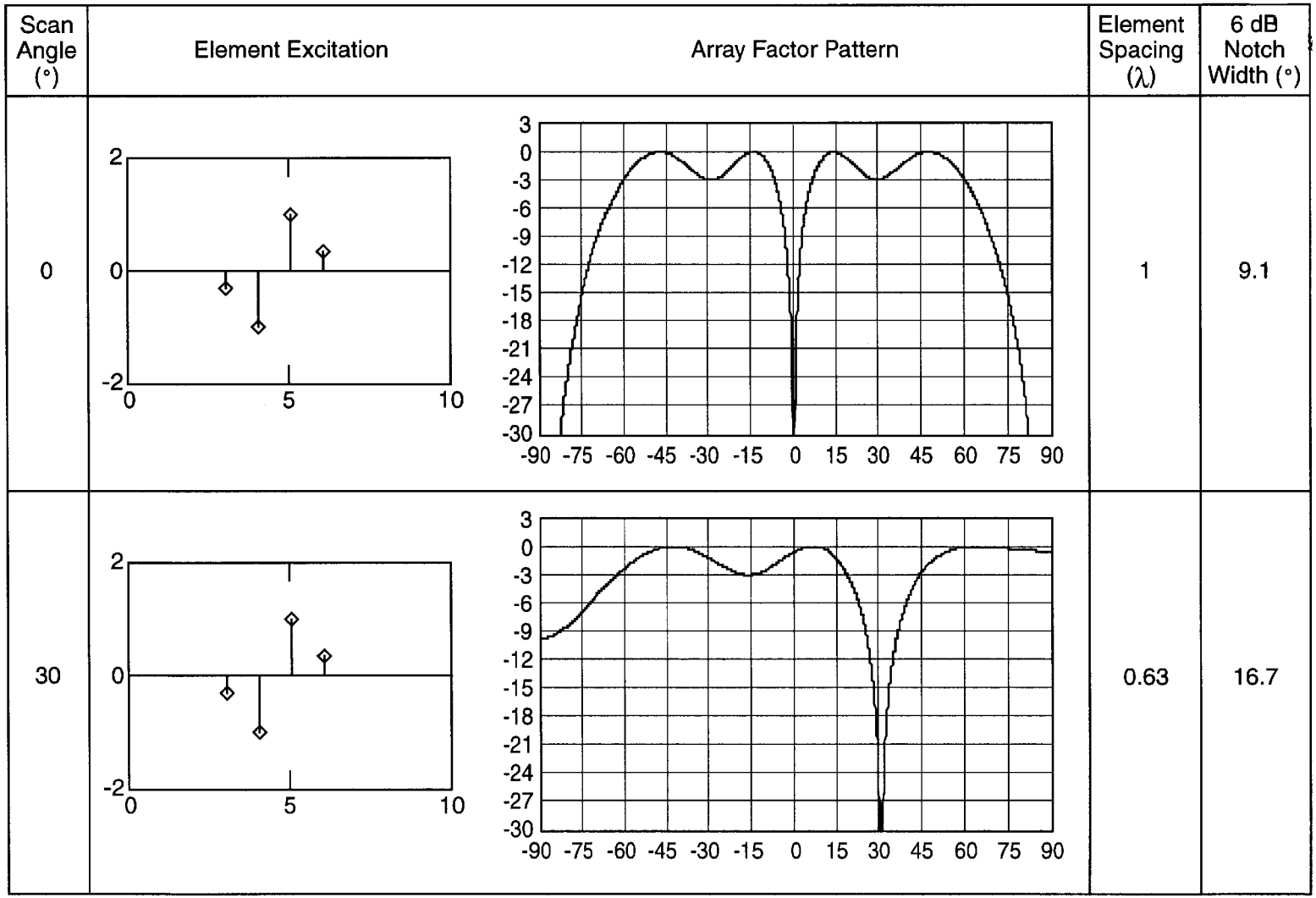
FIG. 4 provides array patterns, relative element excitation levels and related data for four and two element array antennas with radiation pattern notches at angles of zero degrees and 30 degrees off boresight.

An array antenna 10 to provide sector coverage with a radiation pattern notch at a selected angle is shown in FIG. 1. For example, a four dipole linear array antenna may be configured to provide coverage of a 120 degree wide azimuth sector for cellular communications usage. In a particular installation of such an antenna it may be determined that within the sector there exists some form of source of electromagnetic radiation which results in interference signals being incident at the antenna 10 at a fixed angle relative to antenna boresight. For example, such interference signals may come from a source which is fixed in position geographically and be incident on the antenna at a fixed azimuth angle (e.g., a fixed angle Θ of +30 degrees off boresight, or 30 degrees to the right of a line normal to the antenna aperture). What are termed interference signals may be any form of signals or radiated energy that interferes with clear reception of desired signals.

For present purposes, it is assumed that a source of interference is fixed in position, however, resulting interference signals from such a source may be incident on the antenna at any fixed angle within a range of angles within the sector of coverage. As will be described, pursuant to the invention a radiation pattern notch can be provided at such fixed angle to suppress reception of the interference signals, while permitting normal reception of signals incident at other angles within the sector. Of course, many antenna installations will not be subject to the presence of a source of interference signals, so that a need to suppress interference signals to avoid interference with reception of desired signals will not exist.

The FIG. 1 array antenna 10 includes a horizontal array of radiating elements 11, 12, 13, 14, illustrated as dipoles. Relative to centerline 15, the antenna includes left-side elements 11 and 12 and right-side elements 13 and 14. As indicated by + and − signs in FIG. 1, all left-side elements (shown with +, or positive polarity, to left) are arranged for opposite-phase excitation relative to all right-side elements (shown with +, or positive polarity, to right). Thus, a frequency independent 180 degree phase reversal between left and right excitation and radiation phase is achieved in this embodiment by simply physically inverting or reversing the feed direction or polarity as between the lift-side and right-side elements. In other embodiments and for other types of radiating elements suitable excitation configurations can be provided by skilled persons.

As shown, power divider/combiner 20 provides an input/output for each antenna element (e.g., connected to respective coupling lines 21, 22, 23, 24). In this embodiment each input/output is operative with common polarity (phase) signals, with phase reversal provided by dipole feed inversion or reversal. However, as will be discussed further, each left-hand, right-hand pair of elements (i.e., dipoles 12 and 13 and dipoles 11 and 14) may have a different predetermined excitation level for improved radiation pattern characteristics. For example, in a preferred embodiment the excitation level for each element of the outer pair of elements 11 and 14 is one-third the excitation level for each of the two middle elements 12 and 13 of the middle pair.

Array antenna 10 of FIG. 1 further includes left and right coupling lines respectively coupled between the power divider/combiner 20 and the left-side and right-side elements. Left coupling lines 21 and 22 couple to left-side elements 11 and 12, and right coupling lines 23 and 24 couple to right-side elements 13 and 14, respectively. As represented in FIG. 1, the basic line lengths from unit 20 to each dipole are identical, however a line-length differential is introduced by lengthening each left coupling line 21 and 22 as represented by inclusion of lengthening portions 21*a* and 22*a* of lines 21 and 22. As a result, a left coupling line (e.g., line 22) has a line-length differential relative to a right coupling line (e.g., line 23) and it will be appreciated that in a particular application the longer lines may be on the left or right, as appropriate. If $L_L$ represents the length of a left coupling line and $L_R$ represents the length of a right coupling line, the line-length differential can be represented as $L_L$–$L_R$. The line-length differential between left and right coupling lines is selected to provide a phase differential between excitation of left-side and right-side elements, so as to modify the nominally opposite-phase excitation (e.g., resulting from dipole reversal) to produce a radiation pattern notch at a selected angle (i.e., Θ relative to array boresight). It will be understood that, while included in FIG. 1 for purposes of illustration, in typical embodiments lengthening portions (i.e., 21*a* and 22*a*) will not be present as discrete elements.

The FIG. 1 array antenna may also include an input/output port 30 usable to couple signals to or from the antenna, or both, and a reflector assembly 40 provided behind the array of radiating elements in any suitable configuration. In other implementations, an array antenna may include two or a higher even number of radiating elements, which may be dipoles or other suitable types of radiating elements.

FIG. 2 represents an array antenna including two phase-reversed dipoles 1 and 2 with equal phase, equal amplitude excitation via power divider/combiner 20*a*, shown as a circuit junction point. As illustrated, the basic left coupling line length, $L_L$, and right coupling line length, $L_R$, are identical, however, a line-length differential is introduced by the lengthening portion included in the right coupling line, as discussed above. In FIG. 2, the element-to-element spacing between dipoles is shown as D and the angle of a radiation pattern notch, relative to boresight, is represented as Θ.

$$\Psi = \frac{2\pi}{\lambda}\left(-L_L - \frac{D}{2}\sin\theta\right) - \frac{2\pi}{\lambda}\left(-L_R + \frac{D}{2}\sin\theta\right)$$

A radiation pattern notch or null occurs at the angle Θ for which Ψ=.

If the left and right line lengths are equal, so that $L_L$ is equal to $L_R$, then:

$$\psi = 0 = \frac{2\pi}{\lambda}\left(-\frac{D}{2}\sin\theta - \frac{D}{2}\sin\theta\right)$$

$$0 = -\frac{2\pi}{\lambda}D\sin\theta$$

$$\theta = 0$$

If there is a line-length differential, so that $L_L$ is not equal to $L_R$ then:

$$\psi = 0 = \frac{2\pi}{\lambda}(L_R - L_L - D\sin\theta)$$

$$\theta = \sin^{-1}\left(\frac{L_R - L_L}{D}\right)$$

Thus, pursuant to the invention, by appropriate selection of element spacing D and the line-length differential $L_L$–$L_R$, a radiation pattern notch or null is provided at a selected angle Θ. In application of the invention, if interference signals are incident on an antenna at a fixed incident angle, an array antenna can thus be configured to provide a radiation pattern notch or null at an appropriate angle to at least partially suppress reception of the interference signals.

FIG. 3 provides relative excitation levels for array antennas for optimized notch characteristics (i.e., narrowest possible notch width) for array antennas including from two to eight radiating elements. Consistent with FIG. 3, relative excitation amplitudes (An) for individual radiating elements are provided more generally by the following:

$$An=1/(2n-1) \text{ for } n=1, 2, \ldots N/2$$

$$An=-1/(2n-1) \text{ for } n=-1, -2, \ldots -N/2$$

Where:

N is the total number of elements and is an even number.

Elements to the right of center are represented by successive positive integers.

Elements to the left of center are represented by successive negative integers.

Thus, pursuant to FIG. 3, power divider/combiner 20 of FIG. 1 may be configured to provide relative excitation amplitudes of: nominally 1 for each of the first pair of radiating elements, which are adjacent to array center (e.g., elements 12 and 13 of FIG. 1); nominally 1/3 for each of a second pair of elements, which if present are outwardly adjacent to the first pair (e.g., elements of 11 and 14 of FIG. 1); nominally 1/5 for each of a third pair of radiating elements, which if present are outwardly adjacent to the second pair; and nominally 1/7 for each of a fourth pair of radiating elements, which if present are outwardly adjacent to the third pair. These excitation levels are graphically represented (with the phase reversal as previously discussed) in the element excitation for an eight element antenna in the top row in FIG. 5. In this context, relative excitation level indicates that, for example, whatever level of excitation is effective for each of elements 12 and 13 in FIG. 1, excitation of each of elements 11 and 14 is at a level which is one-third of that level. For present purposes, "nominally" is defined as a value which is typically within plus or minus 15 percent of a stated value.

FIG. 4 presents coverage performance, including computer-generated array factor patterns and related information for array antennas with radiation pattern notches, pursuant to the invention. The configurations are optimized for coverage of a 120 degree sector. The first column indicates the angle in degrees, relative to boresight, at which a notch is provided. The second column shows the respective radiating element groupings, with graphical representation of the relative amplitude and phase of excitation thereof (horizontal scale, element positioning and spacing; vertical scale, excitation polarity and amplitude). The array patterns show antenna gain level versus azimuth angle. The fourth and fifth columns respectively show element-to-element spacing, in operating wavelengths, and notch width in degrees, at a level 6 dB down from peak.

As presented in FIG. 4, for a four element array antenna to cover a 120 degree segment, a notch at zero degrees with a 9.1 degree notch width can be provided utilizing one wavelength element spacing and no line-length differential between left coupling lines and right coupling lines. For a notch at 30 degrees, with 0.63 wavelength element spacing and a line-length differential determined as described above, a 16.7 degree notch is indicated. FIG. 4 also provides similar information for a two-element array antenna with a radiation pattern notch at zero or 30 degrees.

Figure 5:
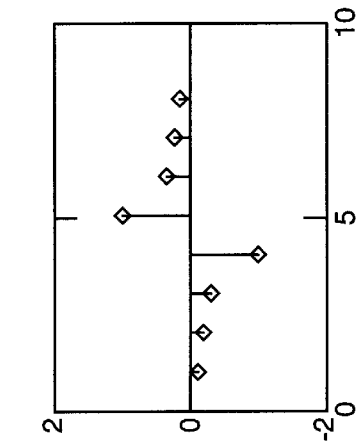
FIG. 5 provides data, as in FIG. 4, for array antennas having eight or six radiating elements.
Figure 5:
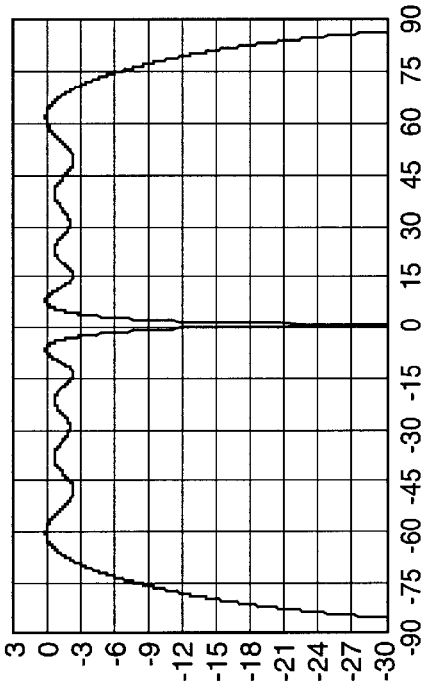
Figure 5:
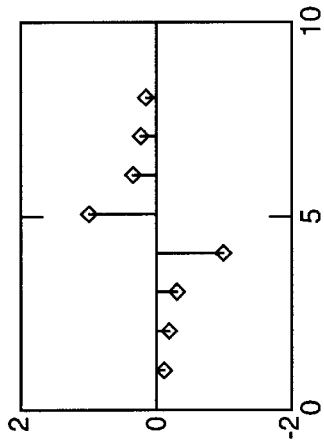
Figure 5:
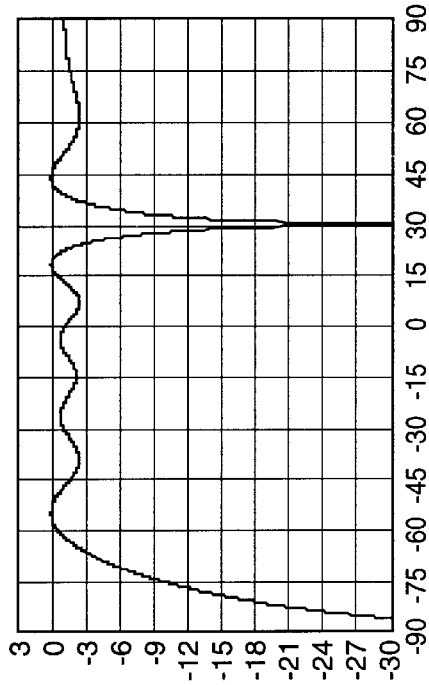

In the same context as FIG. 4, array factor patterns and related information are provided in FIG. 5 for eight and six element array antennas having radiation pattern notches at zero or 30 degrees. It will be appreciated that information for notches at these two angular positions is provided merely by way of example and a notch may be provided at 12 degrees, 43 degrees, or other angles as may be selected in order to address a particular source of interference signals within the coverage of a specific array antenna installation.

Figure 6:
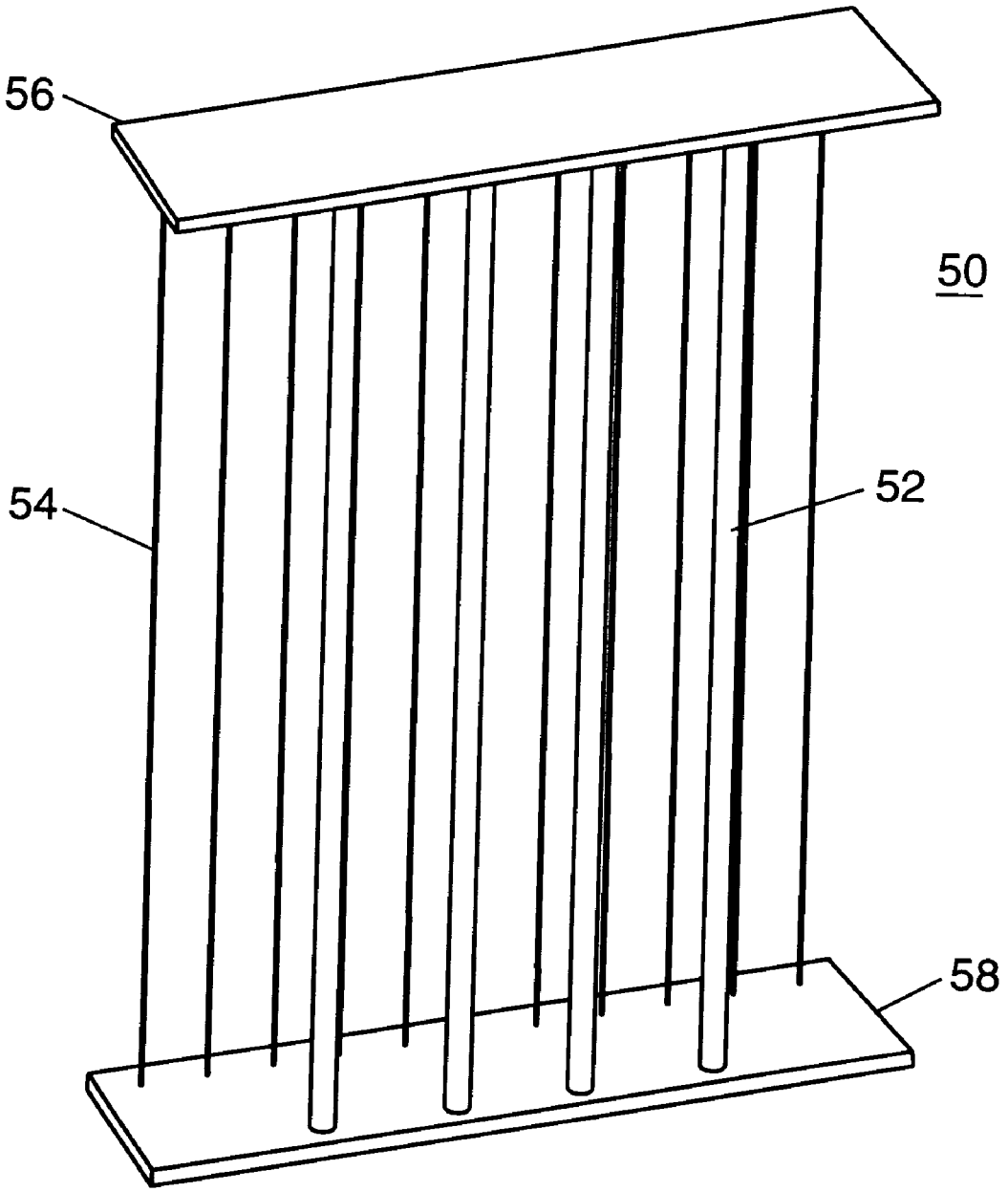
FIG. 6 shows a form of array antenna utilizing four column radiators in front of a wire grid type reflector assembly.

FIG. 6 shows an example of a four element array antenna 50 utilizing column radiators in a configuration suitable for cellular communications applications and characterized by low wind resistance properties. As illustrated, four individual column radiators, of which 52 is typical, are positioned in front of a reflector formed of thin metallic wires or rods, of which 54 is typical. The radiating and reflector elements are positioned by upper and lower support plates or housings 56 and 58. A four-way power divider (e.g., power divider/combiner 20 of FIG. 1) can be positioned within or supported by the portions 56 or 58.

The column radiators of FIG. 6 may, for example, be of the type described in U.S. Pat. No. 5,606,333, issued Feb. 25, 1997, the disclosure of which is hereby incorporated herein by reference. This patent describes radiators including a microstrip pattern of half-wave transmission line sections enclosed in a thin fiberglass tube radome. Phase reversal between individual radiators is dependent on phase of excitation and commonality or reversal of end-to-end alignment of the radiators. The patent describes a reflector formed of tuned reflector units enclosed within thin fiberglass tube radomes. The FIG. 6 antenna may utilize this type of reflector, a wire grid type reflector as represented in FIG. 6, or other suitable form of reflector. While this patent addresses a multi-beam antenna configuration, the radiators described in the patent may be used in a notched-pattern single-beam array antenna as discussed with reference to FIG. 1, for coverage of a sector of 120 degree or other azimuth width.

As initially noted, adaptive array processing and other relatively complex techniques may be employed to automatically steer or position a null or notch to suppress reception at the incident angle of a source of interference signals. The present invention provides simple, inexpensive and reliable array antenna configurations, with broad band performance, enabling a notch to be provided at a selected fixed angle for such purposes. A feature of the invention is that notch width can be minimized, to provide the least loss of signal reception capability at azimuth angles adjacent to the notch. Adaptive processing techniques, on the other hand, do not typically achieve this result. Adaptive techniques may seek optimization of the signal to interference plus noise ratio, for example, and as a result may provide a wider notch and thereby not maximize coverage at azimuth angles adjacent to the azimuth angle of the source of interference signals. By application of the design techniques regarding antenna configuration and relative element excitation, etc., as described above, array antennas having the narrowest possible notch width for a given antenna aperture size, with highest gain properties, can be provided. It should be noted that a fixed-position notch pursuant to the invention, can also be employed in combination with interference suppression techniques using adaptive processing, auxiliary antenna configurations and other known approaches, in order to provide increased interference suppression capabilities.

Examples of antenna configurations have been described. With an understanding of the invention it will be apparent that any suitable type of radiating element may be employed in a variety of forms of antenna appropriate for particular applications. Also, while use of radiating element or feed line reversal is described, the desired phase relation of radiating element excitation may be achieved by provision of line-length differentials of the order of 180 degrees, adjusted for selected angle notch positioning, or by other arrangements suitable to achieve left and right element excitation phases consistent with the preceding description.

While there have been described the currently preferred embodiments of the invention, those skilled in the art will recognize that other and further modifications may be made without departing from the invention and it is intended to claim all modifications and variations as fall within the scope of the invention.

What is claimed is:

1. An array antenna, to provide sector coverage with a radiation pattern notch at a selected angle (Θ) within the sector, comprising:

a horizontal linear array of radiating elements including at least one left-side element and at least one right-side element, all left-side elements arranged for nominally opposite-phase excitation relative to all right-side elements;

a power divider/combiner; and left and right coupling lines respectively coupled between the power divider/combiner and the left-side and right-side elements, including a left coupling line having a line-length differential ($L_L$–$L_R$) relative to a right coupling line, said line-length differential selected to provide a phase differential between excitation of left-side and right-side elements to modify said nominally opposite-phase excitation to produce said radiation pattern notch at the selected angle (Θ), relative to array boresight.

2. An array antenna as in claim 1, wherein the radiating elements are dipoles.

3. An array antenna as in claim 1, wherein all left coupling lines have the same line-length differential relative to all right coupling lines.

4. An array antenna as in claim 1, wherein the horizontal linear array includes two left-side elements and two right-side elements and said power divider/combiner provides relative excitation amplitudes of 1 for each of the two middle radiating elements and 1/3 for each of the two radiating elements outward of the two middle radiating elements.

5. An array antenna as in claim 1, wherein said power divider/combiner is configured to provide relative excitation amplitudes of: nominally 1 for each of the first pair of radiating elements, which are adjacent to array center; nominally 1/3 for each of a second pair of radiating elements, which if present are outwardly adjacent to said first pair; nominally 1/5 for each of a third pair of radiating elements, which if present are outwardly adjacent to said second pair; and nominally 1/7 for each of a fourth pair of radiating elements, which if present are outwardly adjacent to said third pair.

6. An array antenna as in claim 1, additionally comprising:

a reflector assembly positioned behind the horizontal linear array of radiating elements.

7. An array antenna as in claim 1, wherein the array antenna is configured to receive cellular communication signals, subject to interference signals incident from a fixed off-boresight angle, and said line-length differential is selected to position the radiation pattern notch at said off-boresight angle.

8. An array antenna, to provide sector coverage with a radiation pattern notch at a selected angle (Θ) within the sector, comprising:

a horizontal linear array of radiating elements including at least one left-side element and at least one right-side element;

a power divider/combiner; and left and right coupling lines respectively coupled between the power divider/combiner and the left-side and right-side elements, including a left coupling line having a line-length differential ($L_L$–$L_R$) relative to a right coupling line, said line-length differential selected to provide a phase differential between excitation of left-side and right-side elements to produce said radiation pattern notch at the selected angle Θ, relative to array boresight.

9. An array antenna as in claim 8, wherein the radiating elements are dipoles.

10. An array antenna as in claim 8, wherein all left coupling lines have the same line-length differential relative to all right coupling lines.

11. An array antenna as in claim 8, wherein the horizontal linear array includes two left-side elements and two right-side elements and said power divider/combiner provides relative excitation amplitudes of 1 for each of the two middle radiating elements and 1/3 for each of the two radiating elements outward of the two middle radiating elements.

12. An array antenna as in claim 8, wherein said power divider/combiner is configured to provide relative excitation amplitudes of: nominally 1 for each of the first pair of radiating elements, which are adjacent to array center; nominally 1/3 for each of a second pair of radiating elements, which if present are outwardly adjacent to said first pair; nominally 1/5 for each of a third pair of radiating elements, which if present are outwardly adjacent to said second pair; and nominally 1/7 for each of a fourth pair of radiating elements, which if present are outwardly adjacent to said third pair.

13. An array antenna, to provide sector coverage with a radiation pattern notch at a selected angle (Θ) within the sector, comprising:

a horizontal linear array of radiating elements including at least one left-side element and at least one right-side element, all left-side elements arranged for nominally opposite-phase excitation relative to all right-side elements;

a power divider/combiner; and left and right coupling lines respectively coupled between the power divider/combiner and the left-side and right-side elements, including a left coupling line having a line-length differential ($L_L$–$L_R$) relative to a right coupling line, said line-length differential selected to provide a phase differential between excitation of left-side and right-side elements to modify said nominally opposite-phase excitation to produce said radiation pattern notch at the selected angle (Θ), relative to array boresight, where nominally $$\theta = \sin^{-1}\left(\frac{L_R - L_L}{D}\right)$$

with D equal to the lateral spacing between adjacent radiating elements.

14. An array antenna as in claim 13, wherein the radiating elements are dipoles.

15. An array antenna as in claim 13, wherein all left coupling lines have the same line-length differential relative to all right coupling lines.

16. An array antenna as in claim 13, wherein the horizontal linear array includes two left-side elements and two right-side elements and said power divider/combiner provides relative excitation amplitudes of 1 for each of the two middle radiating elements and 1/3 for each of the two radiating elements outward of the two middle radiating elements.

17. An array antenna as in claim 13, wherein said power divider/combiner is configured to provide relative excitation amplitudes of: nominally 1 for each of the first pair of radiating elements, which are adjacent to array center; nominally 1/3 for each of a second pair of radiating elements, which if present are outwardly adjacent to said first pair; nominally 1/5 for each of a third pair of radiating elements, which if present are outwardly adjacent to said second pair; and nominally 1/7 for each of a fourth pair of radiating elements, which if present are outwardly adjacent to said third pair.

18. An array antenna as in claim 13, wherein the array antenna includes radiating elements with a lateral spacing between adjacent elements of nominally one wavelength, within an operating frequency band, for a radiation notch at a selected angle (Θ) equal to zero, and a lateral spacing of less than one wavelength for a radiation notch positioned off array boresight.

* * * * *